US006431028B2

(12) United States Patent
So

(10) Patent No.: US 6,431,028 B2
(45) Date of Patent: Aug. 13, 2002

(54) CORKSCREW

(76) Inventor: Kwok Kuen So, 2nd Floor, Chuan Yuan Factory Building, 342-344 Kwun Tong Road, Kwun Tong, Kowloon, Hong Kong (HK)

( * ) Notice: Subject to any disclaimer, the term of this patent is extended or adjusted under 35 U.S.C. 154(b) by 0 days.

(21) Appl. No.: 09/920,324

(22) Filed: Aug. 2, 2001

(30) Foreign Application Priority Data

Aug. 2, 2000 (GB) ..... 0018957

(51) Int. Cl.[7] ..... B67B 7/04
(52) U.S. Cl. ..... 81/3.29; 81/3.45
(58) Field of Search ..... 81/3.29, 3.45

(56) References Cited

U.S. PATENT DOCUMENTS 5,799,551 A * 9/1998 Vitrac ..... 81/3.09

FOREIGN PATENT DOCUMENTS

| | | |
|---|---|---|
| EP | 863107 | 9/1998 |
| GB | 2322124 | 8/1998 |

* cited by examiner

*Primary Examiner*—Joseph J. Hail, III
*Assistant Examiner*—David B. Thomas
(74) *Attorney, Agent, or Firm*—Leydig, Voit & Mayer, Ltd.

(57) ABSTRACT

A corkscrew includes a body having first and second elongate handgrips connected together for gripping the neck of a wine bottle, a central helical screw between the handgrips to remove a cork from bottle, and a turning knob atop the body and co-axially supporting the screw. The first handgrip has at its upper end a downwardly-opening cavity. The second handgrip is pivotably connected at its upper end to the first handgrip by a connector inserted from below into the cavity. The connector incorporates a hinge pin that passes through the connector and the upper end of the second handgrip. The pin is confined by a peripheral wall of the cavity extending around the connector.

9 Claims, 3 Drawing Sheets

CORKSCREW

The present invention relates to a corkscrew.

BACKGROUND OF THE INVENTION

Corkscrews having a pair of handgrips and a central helical screw are known. In a typical construction, one handgrip is pivotable relatively to the other handgrip for opening to receive the neck of a wine bottle between them and then closing to grip the bottle neck before the screw can be operated. The pivotable handgrip may be connected by means of an integral (plastic) hinge through a snap-fit action, which is convenient but in practice not sufficiently strong. Although a metal rivet or screw will provide the necessary strength, its use is labour intensive and requires finishing work to obscure it.

The invention seeks to mitigate or at least alleviate such problems by providing a-modified corkscrew of this type.

SUMMARY OF THE INVENTION

According to the invention, there is provided a corkscrew comprising a body formed by a pair of first and second elongate handgrips having respective upper ends connected together for gripping the neck of a wine bottle, a central helical screw for use between the handgrips to remove a cork from said bottle, and a turning knob provided atop the body and co-axially supporting the screw for operation, wherein the first handgrip is provided at its upper end with a downwardly-opening cavity and the second handgrip is pivotably connected at its upper end to the first handgrip by means of a connector inserted from below into the cavity, said connector incorporating a hinge pin which passes through the connector and the upper end of the second handgrip for connection and is confined in place by a peripheral wall of the cavity extending around the connector.

Preferably, the connector has a body of an outer shape matching with the shape of the cavity for fitting therein.

More preferably, the connector body occupies substantially the entire interior of the cavity.

It is preferred that the connector body and the cavity have a oval cross-section.

In a preferred embodiment, the or a body of the connector is formed with a gap on one side for receiving the upper end of the second handgrip, and the pin extends across the gap through said upper end for connection.

More preferably, the gap is formed with a pair of aligned through holes on opposite sides and the upper end of the second handgrip is formed with a hole aligned with said pair of holes for the pin to extend through.

In a preferred construction, the upper end of the first handgrip is hollow and extends laterally across to the opposite side to form the cavity integrally.

More preferably, the upper end of the first handgrip is closed by an uppermost horizontal wall having a hole and the connector has an upstanding tubular shaft extending outwards through the hole, through which shaft the screw extends downwards into the corkscrew body.

Further more preferably, the connector is secured within the cavity by ultrasonic welding applied to the interface between an upper surface of the connector and a lower surface of the said wall.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 2:
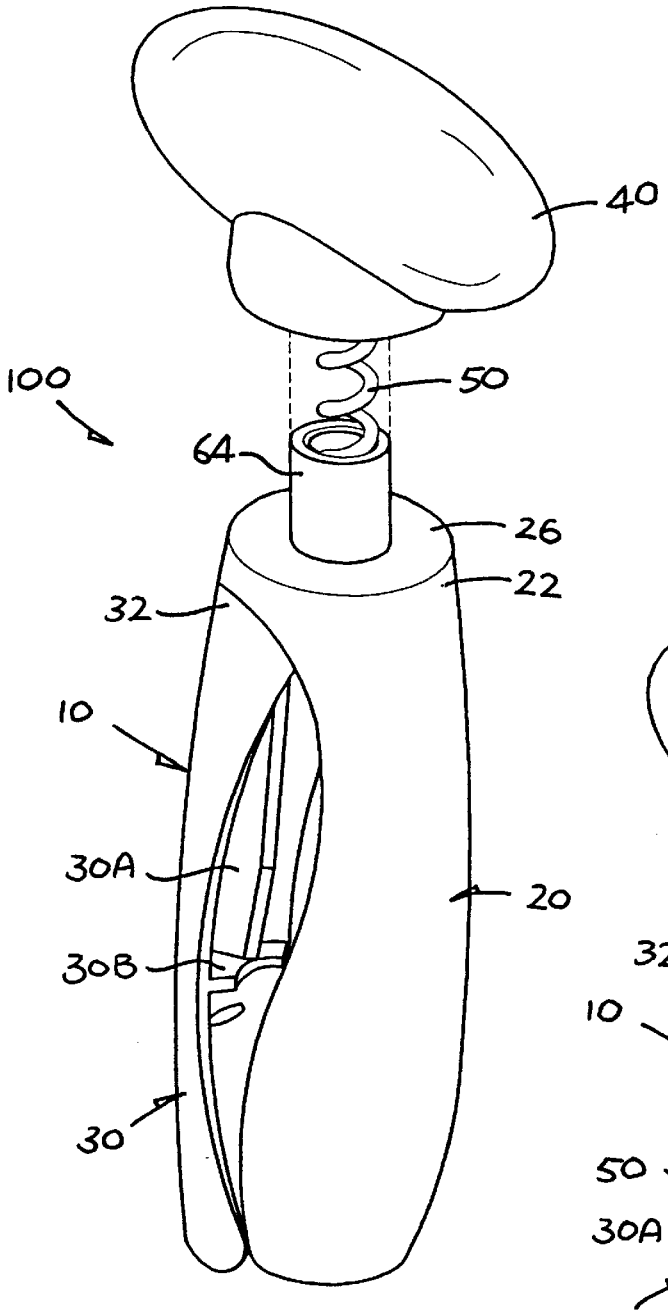
FIG. 2 is a perspective side view corresponding to FIG. 1, showing the turning knob raised from the body.
Figure 1:
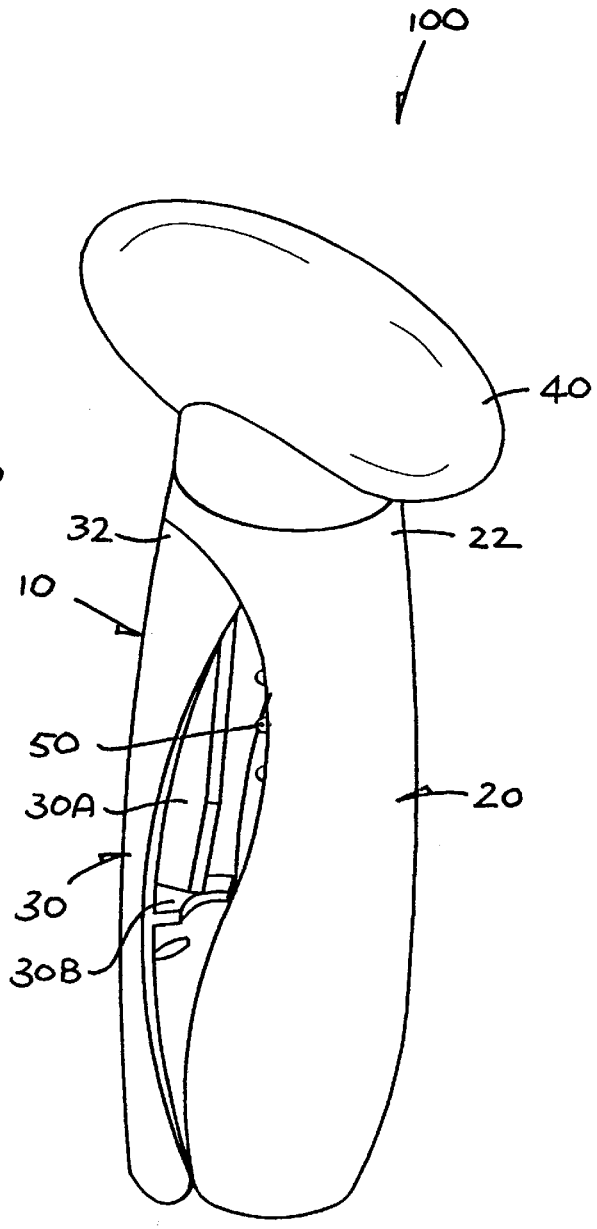
FIG. 1 is a perspective side view of an embodiment of a corkscrew in accordance with the invention, said corkscrew having a body formed by a pair of stationary and pivotable handgrips and a turning knob supporting a central helical screw.

Referring to the drawings, there is shown a corkscrew 100 embodying the invention, which corkscrew 100 has an upright plastic body 10 including a pair of stationary and pivotable elongate handgrips 20 and 30 and includes a separable plastic turning knob 40 provided atop the body 10 and supporting a co-axially extending central metal helical screw 50. The stationary handgrip 20 has an upper end 22 to which an upper end 32 of the other handgrip 30 is pivotally connected by an internal connector 60. The two handgrips 20 and 30 extend side-by-side and together form an openable tubular structure for gripping the neck of a wine bottle.

The upper end 22 of the stationary handgrip 20 is hollow and extends laterally across to the opposite side to form a cavity 24 integrally that opens downwards in a generally flat and generally frusto-conical shape albeit having an oval cross-section. The handgrip end 22 is closed by an uppermost horizontal wall 26 including a central circular hole 28. The connector 60 has a body 62 with an outer shape matching the shape of the cavity 24 to fit therein and occupy substantially the entire interior thereof and includes an integral upstanding tubular central shaft 64 extending outwards through the hole 28. A pair of gaps 66 and 69 extend longitudinally on opposite sides of the body 62, with the first gap 66 being relatively wider than the second gap 69. Opposite sides of the first gap 66 include a pair of aligned holes 67 which extend transversely, through the body 62.

Figure 3:
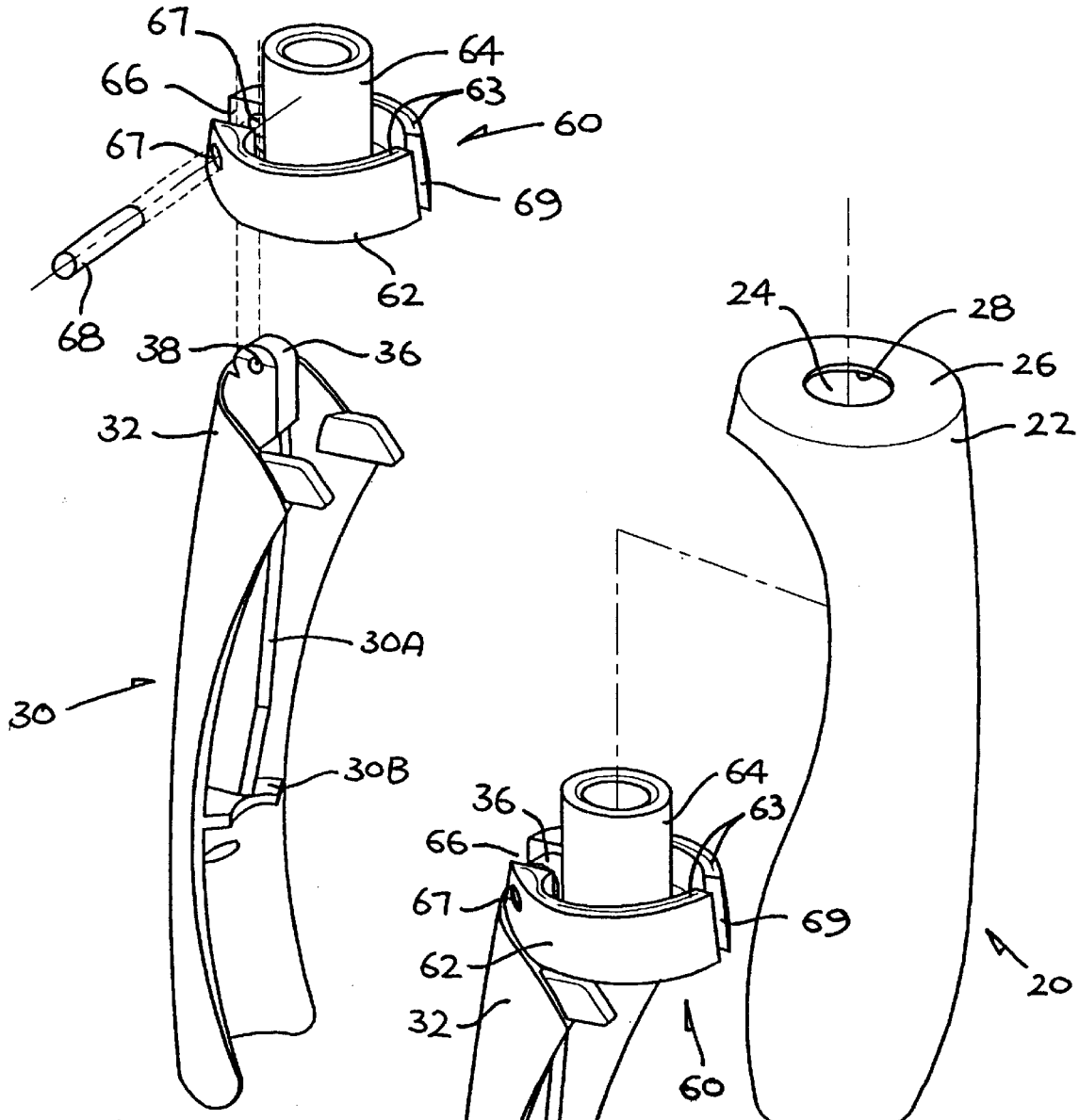
FIG. 3 is a perspective side view showing the pivotable handgrip of FIG. 1 and a connector for connecting this handgrip to the other handgrip.
Figure 4:
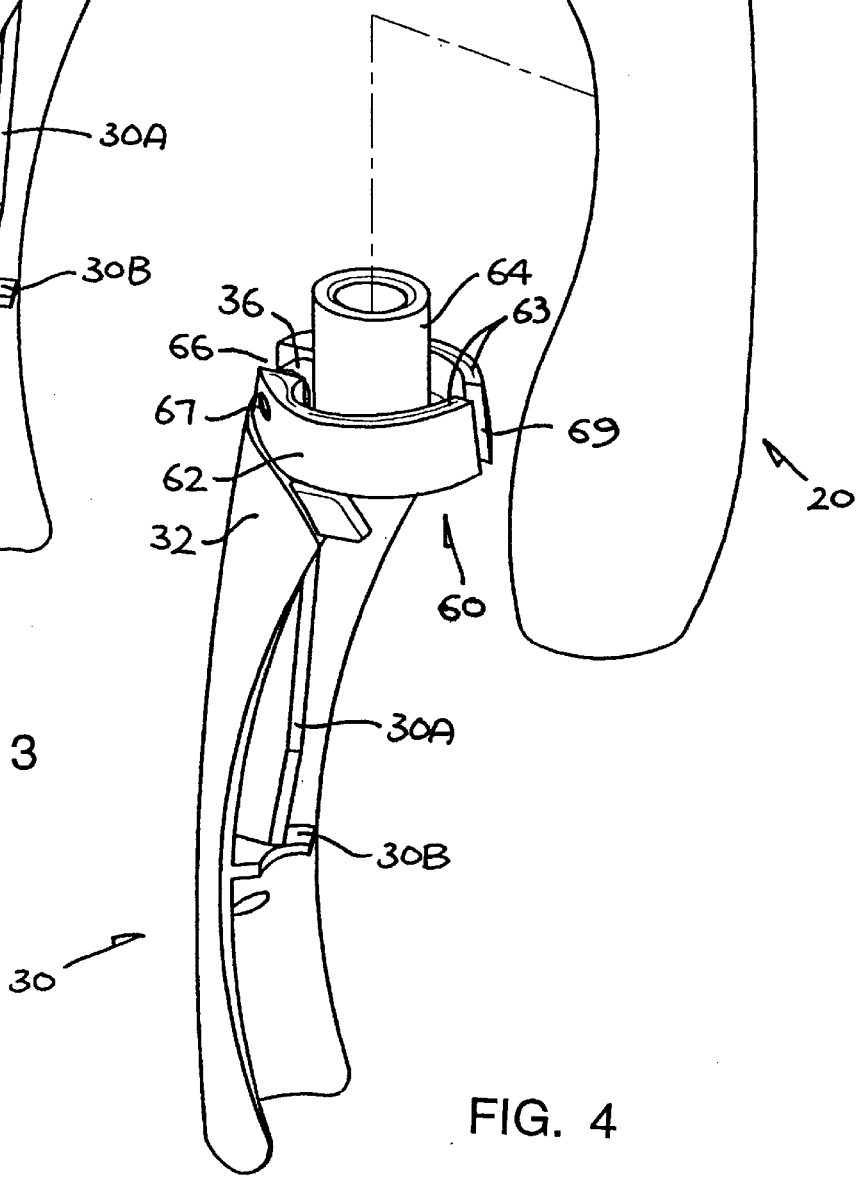
FIG. 4 is a perspective side view corresponding to FIG. 3, showing how the connector connects the pivotable handgrip to the stationary handgrip.
Figure 6:
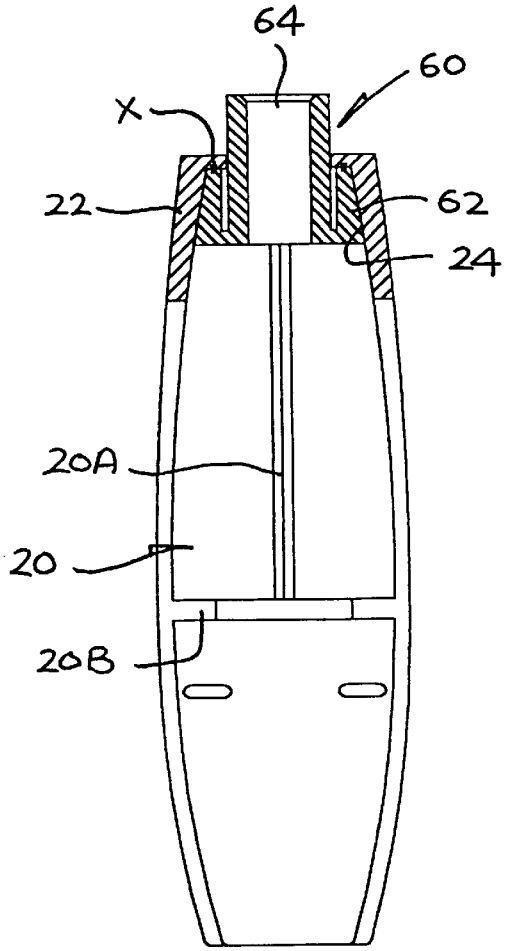
FIG. 6 is a cross-sectional side view of the stationary handgrip and connector of FIG. 5, taken along line VI—VI.
Figure 7:
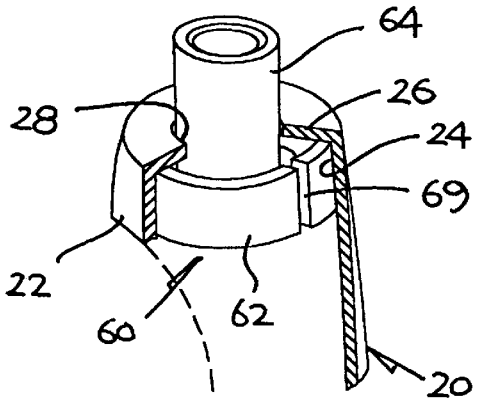
FIG. 7 is a partially cut-away perspective view of a top part of the stationary handgrip and connector of FIG. 6.
Figure 5:
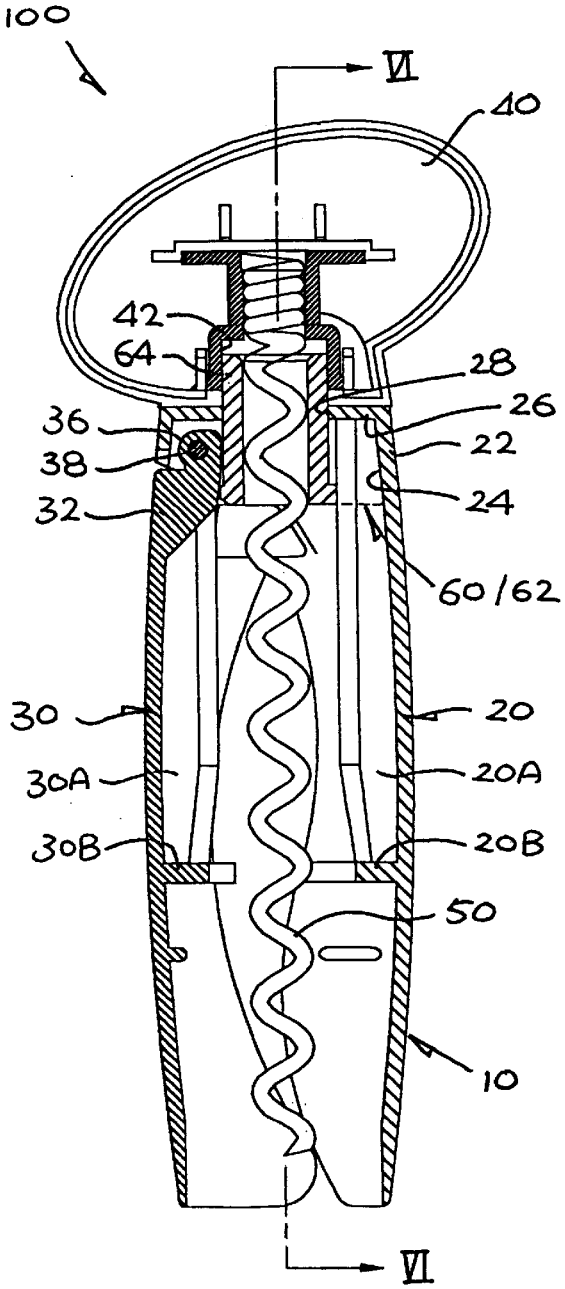
FIG. 5 is a cross-sectional side view of the aforesaid corkscrew.

The upper end 32 of the pivotable handgrip 30 terminates in an uppermost lug 36 for insertion into the gap 66 of the connector 60 for connection, the lug 36 having a transversely-extending hole 38. The handgrip 30 is connected to the connector 60 by a metal hinge pin 68 which passes through the hole 38 of the lug 36 and the holes 67 of the connector body 62 in alignment (FIG. 3). The connector body 62 is subsequently inserted from below into the cavity 24 of the stationary handgrip 20 (FIG. 4) and then secured therein by ultrasonic welding applied to the interface (X in FIG. G) between the upper surface of the body 62, where thin welding ribs 63 are pre-formed, and the lower surface of the wall 26.

The pin 68 is sufficiently long such that it is readily confined in place within the holes 38 and 67 at opposite ends by the peripheral wall of the cavity 24 which extends closely around the connector body 60 and conceals the body 62, holes 67 and pin 68 from sight.

The helical screw 50 extends downwards through the shaft 64 of connector 60 into the body 10 between the handgrips 20 and 30. The turning knob 40 includes a downwardly-opening central recess 42 surrounding the screw 50 to accommodate the shaft 64 such that the knob 40 can be lowered down to rest upon the uppermost wall 26 of the stationary handgrip 20.

On the inner surface of each handgrip 20/30, a vertical rib 20A/30A extending down from the upper end 22/32 and a horizontal flange 20B/30B directly below the rib 20A/30A are integrally formed. The flanges 20B and 30B form an annular stop for engaging the rim of the bottle mouth such that the screw 50 may, upon rotation by the knob 40, remove a cork from the bottle. The ribs 20A and 30A are provided on opposite sides to hold the cork against turning with the screw 50 in action.

The pivotable handgrip 30 is openable for a limited angle of approximately 20° to 30°. It is envisaged that the other handgrip 20 may also be made pivotable in a similar manner, in which case the part 22 (providing the cavity 24) becomes a separate part for receiving a connector (like the connector 60) having opposite sides hinged to respective handgrips, like the handgrip 30. The connector 60 may be secured in the cavity 24 by any other suitable means, such as glue, screws, or snap-fit hooks.

The invention has been given by way of example only, and various other modifications of and/or alterations to the described embodiment may be made by persons skilled in the art without departing from the scope of the invention as specified in the appended claims.

What is claimed is:

1. A corkscrew comprising:

a body including first and second elongate handgrips having respective upper ends connected together for gripping the neck of a wine bottle, a central helical screw between the handgrips for removing a cork from the bottle, a turning knob located atop the body and co-axially supporting the screw, wherein the first handgrip has at the upper end a downwardly-opening cavity; and a connection in the cavity pivotally connecting the second handgrip at the upper end to the first handgrip and, a connector incorporating a hinge pin which passes through the connector and the upper end of the second handgrip and is kept in place by a peripheral wall of the cavity that extends around the connector.

2. The corkscrew as claimed in claim 1, wherein the connector has a body with an outer shape matching with the cavity for fitting in the cavity.

3. The corkscrew as claimed in claim 2, wherein the connector body occupies substantially all of the cavity.

4. The corkscrew as claimed in claim 2, wherein the connector body and the cavity have an oval cross-section.

5. The corkscrew as claimed in claim 1 wherein the connector includes a gap on one side for receiving the upper end of the second handgrip, and the pin extends across the gap through the upper end.

6. The corkscrew as claimed in claim 5, wherein the gap includes a pair of aligned through holes on opposite sides and the upper end of the second handgrip includes a hole aligned with the pair of holes for the pin to extend through.

7. The corkscrew as claimed in claim 1, wherein the upper end of the first handgrip is hollow and extends laterally to an opposite side to define the cavity integrally.

8. The corkscrew as claimed in claim 7 including a horizontal wall closing the upper end of the first handgrip and having a hole, wherein the connector has an upstanding tubular shaft extending outwards through the hole, and the screw extends through the shaft into the corkscrew body.

9. The corkscrew as claimed in claim 8, wherein the connector is secured within the cavity by ultrasonic welding applied to an interface between an upper surface of the connector and a lower surface of the wall.

* * * * *